US010562085B2

(12) United States Patent
Sasaki et al.

(10) Patent No.: US 10,562,085 B2
(45) **Date of Patent: *Feb. 18, 2020**

(54) EQUIPMENT LINE FOR MANUFACTURING HEAVY-WALLED STEEL PRODUCTS

(71) Applicant: JFE STEEL CORPORATION, Tokyo (JP)

(72) Inventors: Shunsuke Sasaki, Tokyo (JP); Tatsuro Katsumura, Tokyo (JP); Yasushi Kato, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 3 days.

This patent is subject to a terminal disclaimer.

(21) Appl. No.: 15/031,247

(22) PCT Filed: Sep. 25, 2014

(86) PCT No.: PCT/JP2014/004891

§ 371 (c)(1),
(2) Date: Apr. 21, 2016

(87) PCT Pub. No.: WO2015/059871

PCT Pub. Date: Apr. 30, 2015

(65) Prior Publication Data

US 2016/0236249 A1 Aug. 18, 2016

(30) Foreign Application Priority Data

Oct. 21, 2013 (JP) ..... 2013-218397

(51) Int. Cl.
*B21B 45/00* (2006.01)
*B21B 19/04* (2006.01)
(Continued)

(52) U.S. Cl.
CPC ..... *B21B 19/04* (2013.01); *B21B 1/38* (2013.01); *B21B 23/00* (2013.01); *B21B 45/00* (2013.01);
(Continued)

(58) Field of Classification Search
CPC ..... B21B 17/02; B21B 17/04; B21B 17/06; B21B 17/08; B21B 17/10; B21B 17/12;
(Continued)

(56) References Cited

U.S. PATENT DOCUMENTS 4,452,061 A * 6/1984 Numano ..... C21D 9/08 72/201
4,658,882 A * 4/1987 Oba ..... B21B 1/466 164/414
(Continued)

FOREIGN PATENT DOCUMENTS

BR PI0413626 A 10/2006
CN 1836056 A 9/2006
(Continued)

OTHER PUBLICATIONS

Jun. 14, 2016 Office Action issued in Japanese Patent Application No. 2013-218397.
(Continued)

*Primary Examiner* — Debra M Sullivan
(74) *Attorney, Agent, or Firm* — Oliff PLC

(57) ABSTRACT

An equipment line for manufacturing heavy-walled steel products having excellent low-temperature toughness, the equipment line including a heating device, a cooling device, and a hot working device in this order. The working device includes plurality of hot working devices, and the cooling device is arranged on an entrance side of at least one of the plurality of hot working devices. Furthermore, a thermostat equipment is arranged on an exit side of the hot working device. The equipment line provides a steel product with a finer microstructure with a relatively small amount of working.

2 Claims, 4 Drawing Sheets

(51) Int. Cl.

| | |
|---|---|
| ***B21B 45/02*** | (2006.01) |
| ***B21B 23/00*** | (2006.01) |
| ***C22C 38/58*** | (2006.01) |
| ***C22C 38/00*** | (2006.01) |
| ***B21B 1/38*** | (2006.01) |
| ***C21D 9/46*** | (2006.01) |
| *C21D 8/10* | (2006.01) |
| *C21D 8/02* | (2006.01) |

(52) U.S. Cl.
CPC ..... *B21B 45/02* (2013.01); *B21B 45/0203* (2013.01); *C21D 9/46* (2013.01); *C22C 38/00* (2013.01); *C22C 38/58* (2013.01); *C21D 8/02* (2013.01); *C21D 8/10* (2013.01)

(58) Field of Classification Search
CPC ..... B21B 45/0203; B21B 45/0215; B21B 45/008
See application file for complete search history.

(56) References Cited

U.S. PATENT DOCUMENTS

| | | | | |
|---|---|---|---|---|
| 7,767,037 | B2 * | 8/2010 | Kimura | C21D 1/25 148/325 |
| 2003/0066580 | A1 | 4/2003 | Miyata et al. | |
| 2006/0243354 | A1 | 11/2006 | Kimura et al. | |
| 2013/0333433 | A1 * | 12/2013 | Kummerling | B21B 23/00 72/97 |
| 2014/0250965 | A1 * | 9/2014 | Yamane | B21B 23/00 72/97 |

FOREIGN PATENT DOCUMENTS

| | | | |
|---|---|---|---|
| EA | 201171189 | A1 | 3/2012 |
| EP | 1 288 316 | A1 | 3/2003 |
| EP | 1 373 589 | B1 | 10/2004 |
| EP | 1 662 015 | A1 | 5/2006 |
| EP | 2 415 884 | A1 | 2/2012 |
| JP | H05-195059 | A | 8/1993 |
| JP | 10-001755 | | 7/1999 |
| JP | 2003-105441 | A | 4/2003 |
| JP | 2004-027351 | A | 1/2004 |
| JP | 2004-124188 | A | 4/2004 |
| JP | 2005-336595 | A | 12/2005 |
| JP | 2011-241477 | A | 12/2011 |
| NO | 20024097 | A | 3/2003 |
| RU | 2225886 | C2 | 3/2004 |
| RU | 2293786 | C2 | 2/2007 |
| WO | 2005/017222 | A1 | 2/2005 |

OTHER PUBLICATIONS

Jan. 6, 2015 International Search Report issued in International Patent Application No. PCT/JP2014/004891.
Oct. 25, 2016 Search Report issued in European Patent Application No. 14856473.5.
Nov. 3, 2017 Office Action issued in U.S. Appl. No. 15/032,421.
Jan. 10, 2018 Office Action issued in Russian Patent Application No. 2016119628.
Jul. 26, 2018 Office Action issued in European Patent Application No. 14857371.0.
May 24, 2018 Office Action issued in U.S. Appl. No. 15/032,421.
May 15, 2018 Office Action issued in European Patent Application No. 14856473.5.

* cited by examiner

EQUIPMENT LINE FOR MANUFACTURING HEAVY-WALLED STEEL PRODUCTS

TECHNICAL FIELD

This application is directed to the manufacture of steel products, more particularly to an equipment line preferable for manufacturing heavy-walled steel products and a method of manufacturing heavy-walled stainless steel products by making use of the equipment line. In this specification, "steel products" include steel plates, steel bars and steel pipes. Further, "heavy-walled" means that a wall thickness of steel product exceeds 15 mm and is not more than 60 mm.

BACKGROUND

Recently, from a view point of the high energy price of crude oil or the like and the exhaustion of oil resource due to the increase in energy consumption volume on a global scale, there has been observed the vigorous energy source development with respect to oil fields having a large depth (deep layer oil fields) which had not been noticed, oil fields and gas fields in a severe corrosion environment which is so-called a sour environment containing hydrogen sulfide or the like, and oil fields and gas fields around the North Pole which is in a severe weather environment. Steel products used in these oil fields and gas fields are required to have high strength, excellent corrosion resistance (sour resistance) and excellent low-temperature toughness.

Conventionally, in oil fields and gas fields in an environment which contains carbon dioxide gas $CO_2$, chloride ion $Cl^-$ and the like, as a steel product used for drilling, 13% Cr martensitic stainless steel has been popularly used. Recently, the use of improved 13Cr martensitic stainless steel having a chemical composition, wherein the content of C is decreased and the contents of Ni, No and the like are increased, has been spreading.

For example, patent document 1 discloses a method of manufacturing a martensitic stainless steel plate wherein the corrosion resistance of 13% Cr martensitic stainless steel (plate) is improved. The martensitic stainless steel plate disclosed in patent document 1 is manufactured by hot working a steel having a chemical composition containing by weight %, 10 to 15% Cr, 0.005 to 0.05% C, 4.0 to 9.0% Ni, 0.5 to 3% Cu, and 1.0 to 3% Mo, wherein the Ni equivalent amount is adjusted to −10 or more, followed by air-cooling to a room temperature, thereafter, heat treatment at a temperature which is equal to or above an $Ac_1$ point at which an austenite fraction becomes 80%, and further, heat treatment at a temperature at which the austenite fraction becomes 60% or less. The thus manufactured martensitic stainless steel (plate) has a microstructure constituted of tempered martensitic phase, martensitic phase and retained austenitic phase, wherein the total fraction of tempered martensitic phase and martensitic phase is 60 to 90%. It is described in patent document 1 that the martensitic stainless steel (plate) enables corrosion resistance and sulfide stress corrosion cracking resistance in a wet carbon dioxide environment and a wet hydrogen sulfide environment to be improved.

Patent document 2 discloses a method of manufacturing a high-strength stainless steel pipe for oil wells having excellent corrosion resistance. The high-strength stainless steel pipe disclosed in patent document 2 is manufactured by heating a steel having a chemical composition containing by mass %, 0.005 to 0.05% C, 0.05 to 0.5% Si, 0.2 to 1.8% Mn, 0.03% or less P, 0.005% or less S, 15.5 to 18% Cr, 1.5 to 5% Ni, 1 to 3.5% Mo, 0.02 to 0.2% V, 0.01 to 0.15% N, 0.006% or less O, wherein $Cr+0.65Ni+0.6Mo+0.55Cu-20C \geq 19.5$ and $Cr+Mo+0.3Si-43.5C-0.4Mn—Ni-0.3Cu-9N11.5$ are satisfied, followed by hot working into a seamless steel pipe, cooling to a room temperature at a cooling rate equal to or above a cooling rate of air cooling, reheating to a temperature of 850° C. or more, cooling down to a temperature equal to or below 100° C. at a cooling rate of the air cooling or more and, thereafter, quenching-tempering treatment where the seamless steel pipe is heated to 700° C. or below. The high-strength stainless steel pipe has a microstructure containing a 10% to 60% of ferrite phase by a volume fraction and the balance being martensitic phase, and a yield strength of 654 MPa or more. It is described in patent document 2 that the high-strength stainless steel pipe for oil wells has high strength, sufficient corrosion resistance also in a high temperature severe corrosion environment up to a temperature of 230° C. containing $CO_2$ and chloride ion $Cl^-$, and further, high toughness with absorbed energy of 50J or more at a temperature of −40° C.

CITATION LIST

Patent Literature

Patent document 1: Japanese Patent Application Laid-open No. 10-1755

Patent document 2: Japanese Patent No. 5109222 (Japanese Patent Application Laid-open No. 2005-336595)

SUMMARY

Technical Problem

As a steel product for oil wells having a large depth, recently, a heavy-walled steel product has been also popularly used. In the manufacture of the heavy-walled steel product, when the steel product is manufactured using conventional hot working, along with the increase in wall thickness of the steel product, it is difficult to impart desired processing strain to the wall thickness center portion of the steel product and hence, there is a tendency for the microstructure of the wall thickness center portion of the steel product to become coarse. Accordingly, the toughness of the wall thickness center portion of the heavy-walled steel product is liable to be deteriorated compared to the toughness of the wall thickness center portion of the light-walled steel product.

Patent documents 1 and 2 aim at the application thereof to steel products having a wall thickness of 12.7 mm at maximum. Neither patent document 1 nor patent document 2 refers to heavy-walled steel products having a wall thickness which exceeds 15 mm. In particular, neither patent document 1 nor patent document 2 refers to the improvement of properties of heavy-walled steel products, particularly, the improvement of low-temperature toughness.

The disclosed embodiments have been made in view of the above-mentioned circumstances of the related art, and it is an object of the present disclosure to provide an equipment line for manufacturing heavy-walled steel products having excellent low-temperature toughness at a wall thickness center portion thereof and a method of manufacturing heavy-walled stainless steel products by making use of the equipment line.

Solution to Problem

To achieve the above-mentioned object, firstly, the inventors have extensively studied various factors which influence toughness of a wall thickness center portion of a heavy-walled stainless steel product. As a result, the inventors have come up with an idea that the most effective method for improving toughness is to make a microstructure finer.

The inventors have made further studies based on such an idea, and have found that the microstructure of a heavy-walled stainless steel product can be made finer by applying cooling to a steel in such a way that the surface of steel is cooled at an average cooling rate of 1.0° C./s or more which is a cooling rate equal to or more than a air-cooling rate until a temperature of 600° C. or above and in a cooling temperature range of 50° C. or more, and by applying hot working to the cooled steel so that the heavy-walled stainless steel product having a wall thickness exceeding 15 mm can remarkably enhance low-temperature toughness even at the wall thickness center position thereof.

Firstly, a result of the experiment which was carried out by the inventors is explained below.

A specimen (wall thickness: 20 mm) was sampled from a stainless steel plate having a chemical composition consisting of by mass %, 0.017% C, 0.19% Si, 0.26% Mn, 0.01% P, 0.002% S, 16.6% Cr, 3.5% Ni, 1.6% Mo, 0.047% V, 0.047% N, 0.01% Al, and Fe as a balance. The sampled specimen was heated to a heating temperature of 1250° C., and held at the heating temperature for a predetermined time (60 min). Thereafter, the specimen was cooled at various cooling rates to various cooling stop temperatures through a range from 1200 to 600° C. at which hot working is carried out. After cooling, the specimen was immediately quenched so as to freeze the microstructure.

Then, the obtained specimen was polished and corroded (corrosion liquid: vilella (1% of picric acid, 5 to 15% of hydrochloric acid, and ethanol)) to observe the microstructure and measure an area ratio of martensitic phase and that of ferrite phase. The martensitic phase was formed by quenching due to the transformation of austenitic phase present at the cooling stop temperature. The obtained result is shown in FIG. 2 exhibiting the relationship between average cooling rate and amount of ferrite (ferrite area ratio) at each cooling stop temperature.

It is understood from FIG. 2 that by cooling the specimen at an average cooling rate of 1.0° C./s or more in a temperature range from the heating temperature to each cooling stop temperature (hot working temperature), the ferrite area ratio becomes larger than the ferrite area ratio obtained by cooling the specimen at an average cooling rate of 0.5° C./s regardless of the cooling stop temperature. Cooling at an average cooling rate of 0.5° C./s is cooling which simulates air-cooling (corresponding to air-cooling) and hence, it is possible to say that the cooling at the average cooling rate of 0.5° C./s is cooling under the condition close to equilibrium state.

That is, in a stainless steel having the above-mentioned chemical composition, usually, the fraction of ferrite phase is high in the heating temperature region, and when the steel is cooled from the heating temperature at a cooling rate substantially equal to a cooling rate of air-cooling, along with lowering of the temperature, the fraction of ferrite phase is decreased and the fraction of austenitic phase is increased. However, by performing accelerated cooling at an average cooling rate of 1.0° C./s or more in a temperature range from the heating temperature to the hot working temperature (cooling stop temperature), the precipitation of austenitic phase can be delayed so that the microstructure having a phase distribution in a non-equilibrium state where the ferrite phase remains in a large amount compared to that in an equilibrium state can be acquired.

The inventors have arrived at an idea that the microstructure can be easily made finer with smaller hot working strain by applying hot working (rolling) to such a steel having the microstructure in a non-equilibrium state. That is, it is considered that by applying strain to ferrite phase present in a non-equilibrium state, a large number of nucleation sites for $\alpha \rightarrow \gamma$ transformation can be formed even with smaller hot working strain and, as a result, austenite phase formed after transformation is made finer whereby low-temperature toughness of stainless steel is enhanced. The inventors have found that heavy-walled stainless steel products having excellent low-temperature toughness can be easily manufactured by taking account of the above-mentioned phenomenon.

The inventors have further found that, to take account of such a phenomenon, it is important to change an conventional equipment line by arranging a cooling system between a heating device and a hot working device or on an entrance side of at least one of hot working devices when the hot working device consists of a plurality of hot working devices in view of necessity of applying predetermined cooling before applying hot working or before completing hot working.

The disclosed embodiments include:

(1) An equipment line for manufacturing heavy-walled steel products, having; a heating device for heating a steel, a hot working device for hot working the heated steel into a heavy-walled steel product, wherein a cooling system is arranged between the heating device and the hot working device.

(2) The equipment line for manufacturing heavy-walled steel products described in (1), wherein the cooling system has a cooling power for cooling the surface of steel at an average cooling rate of 1.0° C./s or more.

(3) The equipment line for manufacturing heavy-walled steel products described in (1) or (2), wherein a thermal insulator is arranged on an exit side of the hot working device.

(4) The equipment line for manufacturing heavy-walled steel products described in any one of (1) to (3), wherein the hot working device consists of a plurality of hot working devices, and the cooling system is arranged on an entrance side of at least one of the plurality of hot working devices.

(5) The equipment line for manufacturing heavy-walled steel products described in (4), wherein the hot working device consists of a piercing device for forming a hollow piece or a hollow steel tube by applying piercing to the heated steel, and a rolling device for forming the hollow piece or the hollow steel tube into a seamless steel pipe having a predetermined shape, and the cooling system is arranged between the heating device and the piercing device or between the piercing device and the rolling device.

(6) A method of manufacturing heavy-walled high-strength steel products by making use of the equipment line described in any one of (1) to (4), comprising;

heating a steel in the heating device, cooling the heated steel in the cooling system, and hot working the cooled steel in the hot working device, or further passing the hot worked steel through the thermal insulator to have a predetermined size, wherein the steel has a chemical composition consisting of by mass %, 0.050% or less C, 0.50% or less Si, 0.20 to 1.80% Mn, 15.5 to 18.0% Cr, 1.5 to 5.0% Ni, 3.5% or less Mo, 0.02 to 0.20% V, 0.01 to 0.15% N, 0.006% or less O, and Fe and unavoidable impurities as a balance, the heating in the heating device is performed such that the steel is heated at a heating temperature which falls within a range from an $Ac_4$ transformation point to less than a melting point, and the cooling in the cooling system is performed such that the heated steel is subjected to cooling at an average cooling rate of 1.0° C./s or above on the surface of steel until a cooling stop temperature of 600° C. or above and in a cooling temperature range of 50° C. or more between a cooling start temperature and the cooling stop temperature. Here, the cooling start temperature is defined as a surface temperature of steel before cooling is started in the cooling system.

(7) The method of manufacturing heavy-walled high-strength stainless steel products described in (6), wherein the steel is cooled at an average cooling rate of 20° C./s or less by passing the hot worked steel through the thermal insulator.

(8) The method of manufacturing heavy-walled high-strength stainless steel products described in (6) or (7), wherein the chemical composition further contains by mass %, at least one group selected from the following element groups A to D;

Group A: 0.002 to 0.050% Al,

Group B: 3.5% or less Cu,

Group C: at least one element selected from 0.2% or less Nb, 0.3% or less Ti, 0.2% or less Zr, 3.0% or less W, and 0.01% or less B, Group D: at least one element selected from 0.01% or less Ca, and 0.01% or less REM (rare-earth metal).

Advantageous Effects

According to the present disclosure, heavy-walled steel products having excellent low-temperature toughness can be easily manufactured thus acquiring industrially outstanding advantageous effects. Further, according to the present disclosure, the microstructure of steel product can be made finer even at the wall thickness center portion thereof with a relatively small amount of hot working. Accordingly, the present disclosure can acquire an advantageous effect that low-temperature toughness can be enhanced even with respect to heavy-walled steel products where the amount of hot working at the wall thickness center position cannot be increased.

DETAILED DESCRIPTION

Figure 1A:
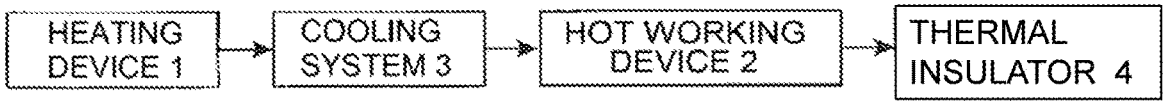
FIG. 1A is an explanatory view schematically showing the equipment line for manufacturing heavy-walled steel products according to embodiments.
Figure 1B:
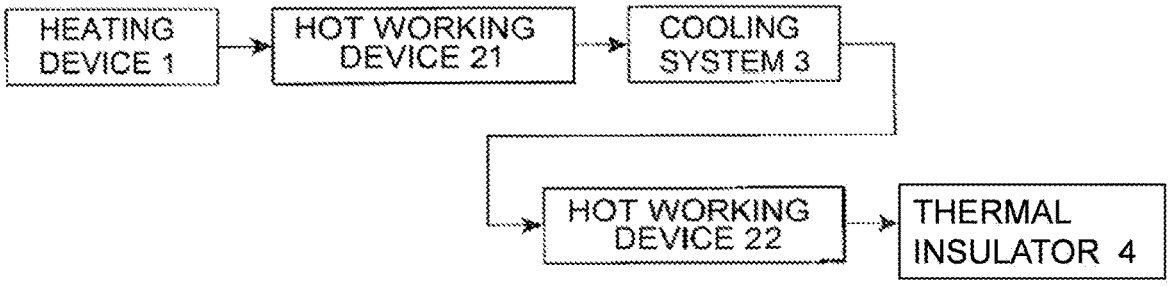
FIG. 1B is an explanatory view schematically showing the equipment line for manufacturing heavy-walled steel products according to embodiments.
Figure 2:
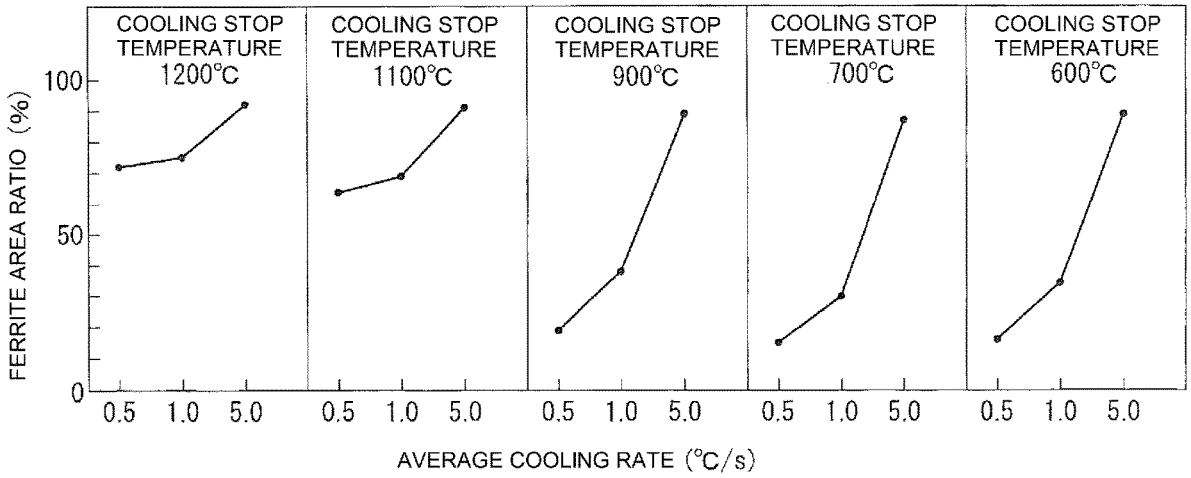
FIG. 2 is a graph showing the relationship between average cooling rate and ferrite area ratio at each cooling stop temperature before hot working.

The equipment line for manufacturing heavy-walled steel products according to the disclosed embodiments is an equipment line where a heated steel is cooled within a proper temperature range and, thereafter, hot working is applied to the steel so that the steel is formed into a heavy-walled steel product. One example of the equipment line for manufacturing heavy-walled steel products is shown in FIG. 1A and FIG. 1B. The equipment line for manufacturing heavy-walled steel products according to the disclosed embodiments is, as shown in FIG. 1A, an equipment line where a heating device 1, a cooling system 3 and a hot working device 2 are arranged in this order. Alternatively, when the hot working device 2 consists of two hot working devices, the equipment line for manufacturing heavy-walled steel products is, as shown in FIG. 1B, an equipment line where a heating device 1, a hot working device 21, a cooling system 3 and a hot working device 22 are arranged in this order. When three or more hot working devices are arranged, it is assumed that the cooling system 3 is arranged on an entrance side of the hot working device which is arranged in a proper position corresponding to respective processing conditions.

It is sufficient that the heating device 1 used is a heating furnace which can heat a steel such as a slab or a billet to a predetermined temperature. Accordingly, the heating device 1 is not particularly limited. When a heavy-walled steel product is a seamless steel pipe, for example, any one of ordinary heating furnaces such as a rotary hearth furnace or a walking beam furnace can be used as the heating device 1. Further, the induction heating furnace may be used as the heating device 1.

As the hot working device 2 used in the disclosed embodiments, any one of hot working devices which are usually used in the case where a steel is formed into a heavy-walled steel product having a predetermined size can be used. When the steel product is a steel plate, various hot rolling devices such as a plate mill can be exemplified. When the steel product is a bar steel, a caliber rolling machine or a drawing working device can be exemplified. When the steel product is a seamless steel pipe, commonly known rolling devices such as a piercing device, a diameter reducing device or a straightening rolling device can be exemplified.

Figure 3A:
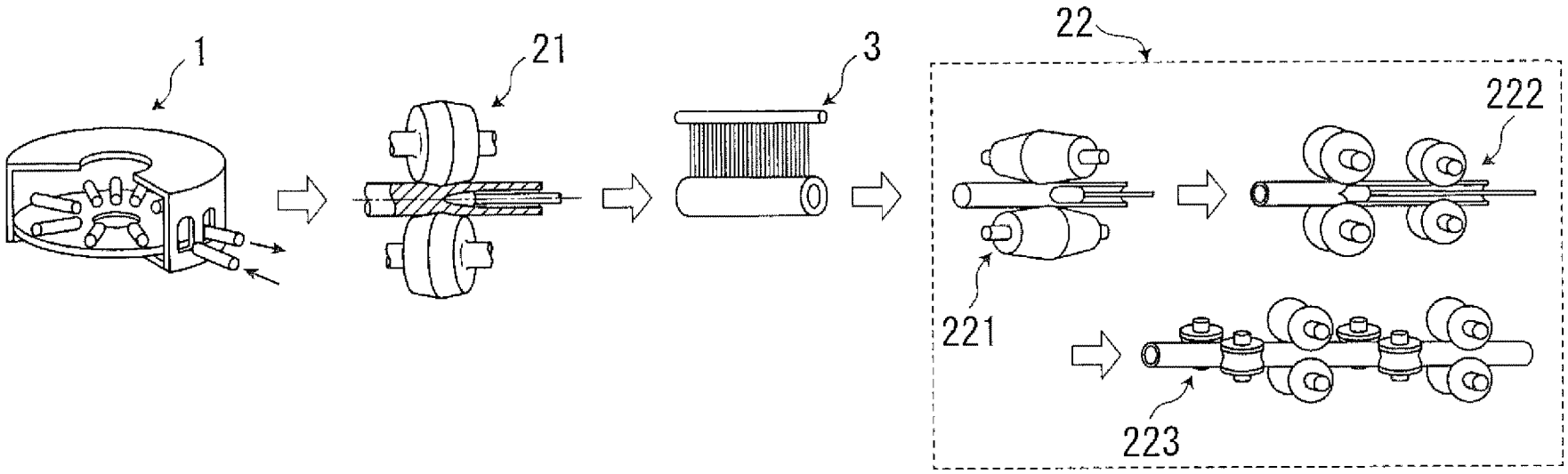
FIG. 3A is an explanatory view schematically showing the equipment line for manufacturing heavy-walled seamless steel pipes according to embodiments.
Figure 3B:
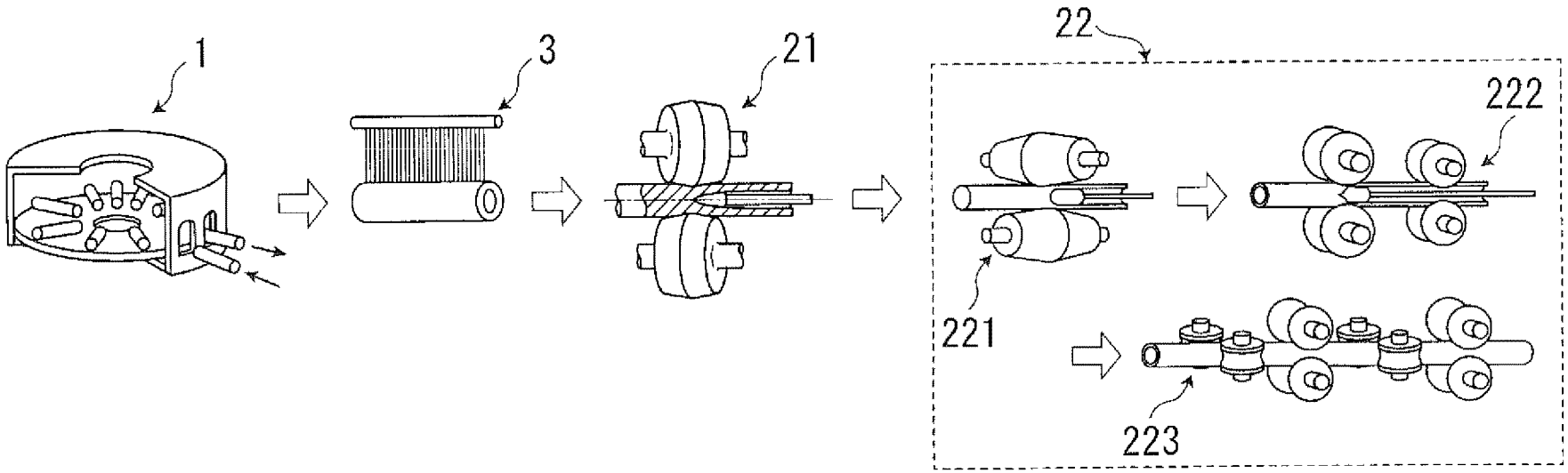
FIG. 3B is an explanatory view schematically showing the equipment line for manufacturing heavy-walled seamless steel pipes according to embodiments.

FIG. 3A and FIG. 3B show one example of a preferred equipment line for manufacturing heavy-walled seamless steel pipes.

It is sufficient that the piercing device 21, which is one example of the hot working device 2, can form a heated steel into a hollow piece by applying piercing to the heated steel. For example, all commonly known piercing devices including a Mannesmann inclined roll type piercing machine which uses barrel shape rolls, corn shape rolls and the like, and a hot extrusion type piercing machine can be used. Further, it is sufficient that the rolling device 22, which is one example of the hot working device 2, is a device which can form a hollow piece into a seamless steel pipe having a predetermined shape by applying hot working to the hollow piece. That is, depending on the purpose, for example, all of commonly known hot working devices can be used. The commonly known hot working device may be a rolling device in which an elongator 221, a plug mill 222 which stretches a pierced hollow pipe into a thin and elongated pipe, a reeler which makes inner and outer surfaces of the pipe smooth (not shown in the drawing), and a sizer 223 which reshapes the pipe into a predetermined size are arranged in this order. The commonly known hot working device may also be a rolling device in which a mandrel mill (not shown in the drawing) which forms a hollow pipe into a steel pipe having a predetermined size and a reducer (not shown in the drawing) which adjusts an outer diameter and a wall thickness by performing a certain amount of rolling reduction are arranged. As the rolling device 22, it is preferable to use the elongator 221 or the mandrel mill which allows a large amount of working.

To acquire a phase distribution in a non-equilibrium state, the cooling system 3 used is arranged between the heating device 1 and the hot working device 2. When the hot working device consists of a plurality of hot working devices, the cooling system is arranged at an appropriate position corresponding to processing conditions. It is preferable to arrange the cooling system 3 on an entrance side of at least one of a plurality of hot working devices. For example, when a steel product is a seamless steel pipe, a plurality of hot working devices, that is, the piercing device 21 and the rolling device 22 are arranged, and the cooling system 3 is arranged between the heating device 1 and the piercing device 21 or between the piercing device 21 and the rolling device 22.

The type of the cooling system 3 used is not particularly limited provided that the cooling system 3 can cool a heated steel at a desired cooling rate or more. As a cooling system which can ensure a desired cooling rate relatively easily, it is preferable to use a system of a type which performs cooling by jetting out or supplying cooling water, compressed air or mist to an outer surface or both the outer surface and an inner surface of heated steel or a steel in the middle of hot working (including a hollow piece).

To acquire a phase distribution in a non-equilibrium state, it is necessary that the cooling system 3 used is a system which has a cooling power capable of acquiring an average cooling rate of 1.0° C./s or more on the surface and at the wall thickness center position of a steel, for example, a stainless steel. When the cooling power is insufficient so that it is only possible to perform cooling at a cooling rate lower than the above-mentioned average cooling rate, the phase distribution in a non-equilibrium state cannot be acquired and hence, even when hot working is performed thereafter, the microstructure of steel product cannot be made finer. Although it is unnecessary to particularly define an upper limit of the cooling rate, it is preferable to set the upper limit of the cooling rate to 50° C./s from a viewpoint of preventing the occurrence of cracks or bending due to thermal stress.

As shown in FIG. 1A and FIG. 1B, it is preferable to adopt the equipment line where a thermal insulator 4 is arranged on an exit side of the hot working device 2. The thermal insulator 4 is arranged when necessary to slow down a cooling rate after hot working. In the case where a steel is a stainless steel, when cooling is performed at an excessively high speed after hot working, a non-equilibrium ferrite phase is cooled without transformation from a (alpha) (ferrite) to γ (gamma) (austenite) resulting in desired fine austenite grains not being able to be generated whereby the microstructure of steel product cannot be made finer. It is sufficient for the thermal insulator to possess a temperature holding ability capable of adjusting a cooling rate at least to approximately 20° C./s or less at the wall thickness center of steel product.

Next, the explanation is made with respect to a method of manufacturing heavy-walled steel products having excellent low-temperature toughness using the above-mentioned equipment line according to the present disclosure by taking a high-strength stainless steel product as an example.

It is preferable that a steel is heated at a predetermined temperature in the heating device, cooled in the cooling system and hot worked in the hot working device or further passed through the thermal insulator after hot working to manufacture a heavy-walled steel product having a predetermined size.

In the disclosed embodiments, provided that the chemical composition of steel can realize the phase distribution in a non-equilibrium state, the preferred chemical composition of steel is not particularly limited. The following chemical composition is particularly preferable because the phase distribution in a non-equilibrium state can be easily ensured.

"The steel has a chemical composition consisting of by mass %;

0.050% or less C, 0.50% or less Si, 0.20 to 1.80% Mn, 15.5 to 18.0% Cr, 1.5 to 5.0% Ni, 3.5% or less Mo, 0.02 to 0.20% V, 0.01 to 0.15% N, 0.006% or less O, further containing by mass % at least one group selected from the following element groups A to D;

Group A: 0.002 to 0.050% Al,

Group B: 3.5% or less Cu,

Group C: at least one elementselected from 0.2% or less Nb, 0.3% or less Ti, 0.2% or less Zr, 3.0% or less W and 0.01% or less B, Group D: at least one elementselected from 0.01% or less Ca and 0.01% or less REM, and Fe and unavoidable impurities as a balance."

Hereinafter, the reasons for limiting the chemical composition are explained. Unless otherwise specified, mass % is simply indicated by "%".

C: 0.050% or less

C is an important element relating to strength of martensite stainless steel. In the present disclosure, it is preferable to set the content of C to 0.005% or more for ensuring desired strength. On the other hand, when the content of C exceeds 0.050%, sensitization at the time of tempering due to the addition of Ni is increased. From a viewpoint of corrosion resistance, it is preferable to set the content of C as small as possible. Accordingly, the content of C is limited to 0.050% or less. The content of Cis preferably 0.030 to 0.050%.

Si: 0.50% or less

Si is an element which functions as a deoxidizing agent. Therefore, it is preferable to set the content of Si to 0.05% or more. When the content of Si exceeds 0.50%, corrosion resistance is deteriorated and hot workability is also deteriorated. Accordingly, the content of Si is limited to 0.50% or less. The content of Si is preferably 0.10 to 0.30%.

Mn: 0.20 to 1.80%

Mn is an element which has a function of increasing strength. To acquire such a strength increasing effect, it is necessary to set the content of Mn to 0.20% or more. On the other hand, when the content of Mn exceeds 1.80%, Mn adversely affects toughness. Accordingly, the content of Mn is limited to 0.20 to 1.80%. The content of Mn is preferably 0.20 to 1.00%.

Cr: 15.5 to 18.0%

Cr is an element which forms a protective coating and has a function of enhancing corrosion resistance. Further, Cr is an element which is present in a solid solution state and thus increases strength of steel. To acquire these effects, it is necessary to set the content of Cr to 15.5% or more. On the other hand, when the content of Cr exceeds 18.0%, hot workability is deteriorated so that strength is further deteriorated. Accordingly, the content of Cr is limited to 15.5 to 18.0%. The content of Cr is preferably 16.6 to 18.0%.

Ni: 1.5 to 5.0%

Ni is an element which has a function of strengthening a protective coating and thus enhancing corrosion resistance. Further, Ni is also an element which is present in a solid solution state and thus increases strength of steel, and further enhances toughness. These effects can be obtained when the content of Ni is 1.5% or more. On the other hand, when the content of Ni exceeds 5.0%, stability of martensitic phase is lowered and strength is lowered. Accordingly, the content of Ni is limited to 1.5 to 5.0%. The content of Ni is preferably 2.5 to 4.5%.

Mo: 3.5% or less

Mo is an element which improves resistance to pitting corrosion caused by $Cl^-$ (pitting corrosion resistance). To acquire such a pitting corrosion resisting effect, it is preferable to set the content of Mo to 1.0% or more. On the other hand, when the content of Mo exceeds 3.5%, strength is lowered and a material cost is sharply pushed up. Accordingly, the content of Mo is limited to 3.5% or less. The content of Mo is preferably 2.0 to 3.5%.

V: 0.02 to 0.20%

V is an element which increases strength and improves corrosion resistance. To acquire these effects, it is necessary to set the content of V to 0.02% or more. On the other hand, when the content of V exceeds 0.20%, toughness is deteriorated. Accordingly, the content of V is limited to 0.02 to 0.20%. The content of V is preferably 0.02 to 0.08%.

N: 0.01 to 0.15%

N is an element which remarkably enhances pitting corrosion resistance. To acquire such a pitting corrosion resisting effect, it is necessary to set the content of N to 0.01% or more. On the other hand, when the content of N exceeds 0.15%, N forms various nitrides thus lowering toughness. The content of N is preferably 0.02 to 0.08%.

O: 0.006% or less

O is present in steel in the form of oxides, and thus adversely affects various properties. Hence, it is preferable to decrease the content of O as small as possible. Particularly, when the content of O exceeds 0.006%, hot workability, toughness and corrosion resistance are remarkably deteriorated. Accordingly, the content of O is limited to 0.006% or less.

The above-mentioned chemical composition is a basic one of steel. In addition, the basic chemical composition may further contain, as selective elements, at least one group selected from the following element groups A to D;

Group A: 0.002 to 0.050% Al,

Group B: 3.5% or less Cu,

Group C: at least one element selected from 0.2% or less Nb, 0.3% or less Ti, 0.2% or less Zr, 3.0% or less W and 0.01% or less B, Group D: at least one elementfrom 0.01% or less Ca and 0.01% or less REM.

Group A: 0.002 to 0.050% Al

Al is an element which functions as a deoxidizing agent. To acquire such a deoxidizing effect, it is preferable to set the content of Al to 0.002% or more. However, when the content of Al exceeds 0.050%, Al adversely affects toughness. Accordingly, when the steel contains Al, it is desirable to limit the content of Al to 0.002 to 0.050%. When Al is not added, the presence of approximately less than 0.002% of Al is allowed as an unavoidable impurity.

Group B: 3.5% or less Cu

Cu strengthens a protective coating, suppresses the intrusion of hydrogen into steel, and improves sulfide stress corrosion cracking resistance. When the content of Cu becomes 0.5% or more, these effects become apparent. When the content of Cu exceeds 3.5%, the grain boundary precipitation of CuS is brought about and hence, hot workability is deteriorated. Accordingly, when the steel contains Cu, it is preferable to limit the content of Cu to 3.5% or less. It is more preferable to set the content of Cu to 0.8% to 1.2%.

Group C: at least one element selected from 0.2% or less Nb, 0.3% or less Ti: 0.2% or less Zr, 3.0% or less W and 0.01% or less B All of Nb, Ti, Zr, W and B are elements which increase strength, and therefore, the steel can contain these elements selectively when required. Such a strength increasing effect can be obtained when the steel contains at least one element selected from 0.03% or more Nb, 0.03% or more Ti, 0.03% or more Zr, 0.2% or more W and 0.01% or more B. On the other hand, when the content of Nb exceeds 0.2%, the content of Ti exceeds 0.3%, the content of Zr exceeds 0.2%, the content of W exceeds 3.0% or the content of B exceeds 0.01%, toughness is deteriorated. Accordingly, when the steel contains Nb, Ti, Zr, W or B, it is preferable to set the content of Nb to 0.2% or less, the content of Ti to 0.3% or less, the content of Zr to 0.2% or less, the content of W to 3.0% or less, and the content of B to 0.01% or less respectively.

Group D: at least one element selected from 0.01% or less Ca and 0.01% or less REM Ca and REM have a function of forming a shape of sulfide inclusion into a spherical shape. That is, Ca and REM have an effect of lowering hydrogen trapping ability of inclusion by decreasing a lattice strain of matrix around the inclusion. The steel can contain at least one element of Ca and REM when necessary. Such a hydrogen trapping ability lowering effect becomes apparent when the content of Ca is 0.0005% or more and the content of REM is 0.001% or more. On the other hand, when the content of Ca exceeds 0.01% or the content of REM exceeds 0.01%, corrosion resistance is deteriorated. Accordingly, when the steel contains at least one of Ca and REM, it is preferable to limit the content of Ca to 0.01% or less and the content of REM to 0.01% or less.

The balance other than the above-mentioned elements is formed of Fe and unavoidable impurities. The steel is allowed to contain 0.03% or less P and 0.005% or less S as unavoidable impurities.

The method of manufacturing the steel having the above-mentioned chemical composition is not particularly limited. As the steel, it is preferable to use billets (round billets) which are manufactured such that a molten steel having the above-mentioned chemical composition is prepared using a usual smelting furnace such as a convertor or an electric furnace, and the billets are produced by a usual casting method such as a continuous casting. The steel may be prepared in the form of billets having a predetermined size by hot rolling. Further, there arises no problem when billets are manufactured using an ingot-making and blooming method.

Firstly, a steel having the above-mentioned chemical composition is charged into a heating device, and is heated to a temperature which falls within a range from an $Ac_4$ transformation point to less than a melting point.

Heating temperature: $Ac_4$ transformation point to less than melting point

When a heating temperature is below an $Ac_4$ transformation point, the microstructure cannot be made finer because the phase transformation does not occur. Further, deformation resistance becomes excessively high and hence, hot working which is performed after heating becomes difficult. On the other hand, when the heating temperature is a melting point or above, strain accumulation by forming (working) becomes difficult. Accordingly, a heating temperature of steel is limited to a temperature which falls within a range from an $Ac_4$ transformation point to less than a melting point. From a viewpoint that deformation resistance is small so that the steel can be easily worked or from a viewpoint that large temperature difference can be acquired at the time of cooling the steel, the heating temperature is preferably set to 1000 to 1300° C. When piercing is performed as hot working after cooling as in the case of manufacturing a seamless steel pipe, the heating temperature is more preferably set to 1200 to 1300° C.

Next, the heated steel is cooled to a predetermined cooling stop temperature at a predetermined cooling rate in a cooling system.

In cooling the steel, cooling is performed such that the steel is subjected to accelerated cooling at an average cooling rate of 1.0° C./s or above on the surface of steel until a cooling stop temperature of 600° C. or above and in a cooling temperature range of 50° C. or more between a cooling start temperature and the cooling stop temperature. The cooling start temperature is a surface temperature of steel before cooling is started, and is preferably set to 650° C. or above. When the cooling start temperature is below 650° C., deformation resistance becomes high so that working (forming) applied to the steel thereafter becomes difficult.

Cooling Temperature Range: 50° C. or More

The cooling temperature range (cooling temperature difference), that is, the temperature difference between the cooling start temperature and the cooling stop temperature is set to 50° C. or more. When the temperature cooling range is less than 50° C., the clear phase distribution in a non-equilibrium state cannot be ensured and hence, the desired finer microstructure cannot be acquired by hot working performed after cooling. Accordingly, a cooling temperature range is set to 50° C. or more. As the cooling temperature range is increased, the phase distribution in a non-equilibrium state can be more easily ensured. The cooling temperature range is preferably set to 100° C. or more.

Cooling Stop Temperature: 600° C. or Above

The cooling stop temperature is set to 600° C. or above. When the cooling stop temperature is below 600° C., the diffusion of elements is delayed so that phase transformation ($\alpha \rightarrow \gamma$ transformation) brought about by hot working applied to the steel is delayed and hence, an advantageous effect of making the microstructure finer brought about by applying desired hot working to the steel cannot be expected. Accordingly, the cooling stop temperature is limited to 600° C. or above. The cooling stop temperature is preferably set to 700° C. or above. When piercing is performed after cooling in the manufacture of the seamless steel pipe, the cooling stop temperature is preferably set to 1000° C. or above.

Average Cooling Rate: 1.0° C./s or More

When the average cooling rate on the surface of steel is less than 1.0° C./s, the phase distribution in a non-equilibrium state cannot be ensured and hence, the desired finer microstructure cannot be acquired by hot working performed after cooling. Accordingly, the average cooling rate is limited to 1.0° C./s or more. An upper limit of the cooling rate is determined based on a capacity of the cooling system. Although it is unnecessary to particularly define an upper limit of the cooling rate, from a viewpoint of preventing the occurrence of cracks or bending due to thermal stress, it is preferable to set the upper limit of the cooling rate to 50° C./s or less. It is more preferable to set the upper limit of the cooling rate to 3 to 10° C./s.

Next, the steel which is cooled to the predetermined cooling stop temperature is subjected to the hot working so that the steel is formed into a heavy-walled steel product having a predetermined size. The time from a point where the cooling is finished to a point where the hot working is applied to the steel is preferably set to 600 s or less. When this time is prolonged exceeding 600 s, ferrite phase is transformed into austenitic phase and hence, it is difficult to ensure a non-equilibrium state.

It is sufficient for the hot working applied to the steel after cooling to make it possible that the steel can be formed into a heavy-walled steel product having a predetermined size. Accordingly, the hot working applied to the steel after cooling is not particularly limited, and all usually-available hot working conditions can be used. According to the present disclosure, the microstructure can be made finer in a desired manner even when an amount of processing (rolling reduction) is relatively small. However, from a viewpoint of making the microstructure finer, it is desirable to set a cumulative amount of processing to 15% or more.

It is unnecessary to particularly limit a cooling rate after hot working. However, when cooling is performed with a cooling rate which exceeds an average cooling rate of 20° C./s on the surface of steel, it is preferable to adjust the average cooling rate to 20° C./s or less by charging a steel into a thermal insulator arranged on an exit side of the hot working device. When the cooling rate after hot working becomes excessively high exceeding 20° C./s, the precipitation of austenitic phase due to the transformation from a to $\gamma$ ($\alpha \rightarrow \gamma$) is delayed so that the steel is cooled without precipitating austenitic phase. Accordingly, the microstructure after the hot working is frozen and hence, the microstructure cannot be made finer in a desired manner.

The explanation has been made heretofore with respect to the case where the cooling system is arranged between the heating device and the hot working device. However, when a plurality of hot working devices are arranged, the cooling system may be arranged on an entrance side of the hot working device at an appropriate position among a plurality of hot working devices. For example, when a heavy-walled steel product is a seamless steel pipe, a steel is formed into a hollow piece by piercing using a piercing device and, thereafter, the hollow piece is formed into a seamless steel pipe having a predetermined size using a rolling device arranged downstream of the piercing device. It is possible to expect the same advantageous effect between the case where the equipment line in which the cooling system is arranged between the hot working device (piercing device) and the hot working device (rolling device) is used and the case where the equipment line in which the cooling system is arranged between the heating device and the hot working device (piercing device) is used. This is because it is confirmed that a working mode of the hot working device only slightly affects the advantageous effect in the present disclosure.

A heavy-walled steel product acquired by the above-mentioned manufacturing method is a steel product having the above-mentioned chemical composition and also having a microstructure constituted of martensitic phase as a main phase, ferrite phase and/or residual austenitic phase. "main phase" is a phase which exhibits the largest area ratio. The content of the residual austenitic phase is 20% or less in terms of the area ratio. The steel pipe having such a microstructure becomes a heavy-walled steel product having high strength where yield strength is 654 MPa or more and excellent low-temperature toughness where absorbed energy at a test temperature of −40° C. in Charpy impact test at the wall thickness center portion is 50J or more.

Next, the present disclosure is further explained based on an example.

Example

Molten steels having the chemical composition shown in Table 1 were prepared by a convertor, and cast into slabs having a thickness of 260 mm by a continuous casting method. Then, hot rolling is applied to the slabs to obtain steels having a thickness of 80 mm. By making use of the equipment line shown in FIG. 1A, these steels were charged into the heating device 1, heated to temperatures shown in Table 2, and held for a fixed time (60 min). Thereafter, the steels were cooled to a cooling stop temperature shown in Table 2 at an average cooling rate shown in Table 2 in the cooling system 3 using a water spray. Immediately after cooling, hot rolling (hot working) was applied to the steels at a cumulative rolling reduction ratio shown in Table 2 in the hot working device 2 (hot mill) and, after such hot working, the steels were cooled by natural cooling or using the thermal insulator 4 thus manufacturing heavy-walled steel plates (steel products) having a plate thickness shown in Table 2. Some heavy-walled steel plates were naturally cooled (0.5° C./s) after heating without using the cooling system 3 of the equipment line shown in FIG. 1A.

Specimens were sampled from the heavy-walled steel plates, and the observation of microstructure, the tensile test and the impact test were carried out. The following testing methods were used.

(1) Observation of Microstructure

Specimens for microstructure observation were sampled from the heavy-walled steel plates. Cross-sections (C cross sections) orthogonal to the rolling direction of the specimens were polished and corroded (corrosion liquid: vilella liquid). The microstructure was observed using an optical microscope (magnification: 100 times) or a scanning electron microscope (magnification: 1000 times), and the microstructure was imaged, and the kind and the fraction of the microstructure was measured using an image analysis. As an index for determining whether or not the microstructure was made finer, the number of boundaries of phases which intersect with a straight line of a unit length was measured from the microstructure photographs. The acquired value of the number of boundary of phases per unit length is indicated as a ratio with respect to a reference value (phase boundary number ratio) by setting a value of steel plate No. 5 as the reference (1.00).

(2) Tensile Test

Round bar type tensile specimens (parallel portion 6 mmϕ×GL20 mm) were sampled from the acquired heavy-walled steel plates such that the rolling direction is aligned with the tensile direction, a tensile test was carried out in accordance with the provision stipulated in JIS Z 2241, and yield strength YS is obtained with respect to each specimen. Here, the yield strength is a strength at the elongation of 0.2%.

(3) Impact Test

V-notched test bar specimens are sampled from the wall thickness center portion of the acquired heavy-walled steel plates such that the direction orthogonal to the rolling direction (C direction) is aligned with the longitudinal direction of specimen, and a Charpy impact test was carried out in accordance with the provision stipulated in JIS Z 2242. The absorbed energy at a test temperature of −40° C. ($vE_{-40}$) was measured and the toughness of each specimen was evaluated. Three specimens were prepared with respect to each heavy-wall steel plate, and an average value of absorbed energies is set as vE_40 of the heavy-walled steel plate.

The results are shown in Table 3.

TABLE 1

| Steel No. | Chemical composition (mass %) | | | | | | | | | | | | | | |
|---|---|---|---|---|---|---|---|---|---|---|---|---|---|---|---|
| | C | Si | Mn | P | S | Cr | Ni | Mo | V | Al | Cu | Nb, Ti, Zr, W, B | Ca, REM | N | O |
| A | 0.016 | 0.20 | 0.25 | 0.01 | 0.002 | 16.5 | 3.4 | 1.5 | 0.047 | 0.01 | 0.89 | — | — | 0.044 | 0.0030 |
| B | 0.021 | 0.19 | 0.36 | 0.01 | 0.001 | 17.5 | 3.6 | 2.5 | 0.055 | 0.01 | — | Nb: 0.066 | — | 0.056 | 0.0022 |
| C | 0.026 | 0.22 | 0.28 | 0.02 | 0.001 | 17.5 | 2.3 | 2.3 | 0.044 | 0.01 | 0.80 | — | REM: 0.01 | 0.063 | 0.0033 |
| D | 0.024 | 0.20 | 0.37 | 0.02 | 0.001 | 16.7 | 3.8 | 1.8 | 0.037 | 0.01 | 1.25 | — | Ca: 0.002 | 0.043 | 0.0029 |
| E | 0.021 | 0.20 | 0.35 | 0.02 | 0.001 | 17.9 | 3.5 | 1.9 | 0.050 | 0.01 | — | — | Ca: 0.001 | 0.038 | 0.0026 |
| F | 0.019 | 0.23 | 0.30 | 0.02 | 0.001 | 15.5 | 4.0 | 2.3 | 0.045 | 0.01 | 0.75 | Nb: 0.045 | — | 0.050 | 0.0018 |
| G | 0.048 | 0.35 | 0.26 | 0.01 | 0.001 | 17.3 | 0.9 | 2.1 | 0.055 | 0.02 | — | — | — | 0.061 | 0.0016 |
| H | 0.018 | 0.22 | 0.32 | 0.01 | 0.001 | 16.8 | 3.5 | 2.5 | 0.052 | 0.002 | — | — | — | 0.052 | 0.0025 |
| I | 0.025 | 0.18 | 0.25 | 0.01 | 0.001 | 16.8 | 3.8 | 2.0 | 0.045 | 0.01 | 0.07 | Nb: 0.065, W: 2.5, Ti: 0.1 | — | 0.045 | 0.0025 |

TABLE 2

| Steel plate No. | Steel No. | Use or non-use of equipment line of present invention | Heating Heating temperature (° C.) | Cooling after heating: Cooling start temperature (° C.) | Average cooling rate (° C./s) | Cooling stop temperature (° C.) | Cooling temperature range (° C.) | Hot working: Cumulative rolling reduction ratio (%) | Cooling rate after hot working * | Plate thickness mm | Remarks |
|---|---|---|---|---|---|---|---|---|---|---|---|
| 1 | A | not used | 1250 | 1250 | 0.5 | 1210 | 40 | 75 | ○ | 15 | comparison example |
| 2 | A | not used | 1250 | 1250 | 0.5 | 1210 | 40 | 25 | ○ | 45 | comparison example |
| 3 | A | not used | 1250 | 1250 | 0.5 | 1195 | 55 | 50 | ○ | 30 | comparison example |
| 4 | A | not used | 1250 | 1250 | 0.5 | 1010 | 240 | 50 | ○ | 30 | comparison example |
| 5 | A | not used | 1250 | 1250 | 0.5 | 890 | 360 | 50 | ○ | 30 | comparison example |
| 6 | A | not used | 1250 | 1250 | 0.5 | 620 | 630 | 50 | ○ | 30 | comparison example |
| 7 | A | used | 1250 | 1250 | 5.0 | 1210 | 40 | 50 | ○ | 30 | comparison example |
| 8 | A | not used | 1250 | 1250 | 0.5 | 890 | 360 | 50 | X | 30 | comparison example |
| 9 | A | used | 1250 | 1250 | 1.1 | 920 | 330 | 50 | ○ | 30 | present invention example |

TABLE 2-continued

| Steel plate No. | Steel No. | Use or non-use of equipment line of present invention | Heating Heating temperature (° C.) | Cooling after heating: Cooling start temperature (° C.) | Average cooling rate (° C./s) | Cooling stop temperature (° C.) | Cooling temperature range (° C.) | Hot working: Cumulative rolling reduction ratio (%) | Cooling rate after hot working * | Plate thickness mm | Remarks |
|---|---|---|---|---|---|---|---|---|---|---|---|
| 10 | A | used | 1250 | 1250 | 8.9 | 915 | 335 | 50 | ○ | 30 | present invention example |
| 11 | A | used | 1250 | 1250 | 12.5 | 905 | 345 | 50 | ○ | 30 | present invention example |
| 12 | A | used | 1250 | 1250 | 12.5 | 905 | 345 | 5 | ○ | 57 | present invention example |
| 13 | A | used | 1250 | 1250 | 10.5 | 605 | 645 | 50 | ○ | 30 | present invention example |
| 14 | A | used | 1150 | 1150 | 1.2 | 1095 | 55 | 50 | ○ | 30 | present invention example |
| 15 | A | used | 1150 | 1150 | 8.9 | 1085 | 65 | 50 | ○ | 30 | present invention example |
| 16 | A | used | 1150 | 1150 | 12.5 | 1085 | 65 | 50 | ○ | 30 | present invention example |
| 17 | A | used | 1250 | 1250 | 12.5 | 905 | 345 | 50 | X | 30 | comparison example |
| 18 | B | not used | 1250 | 1250 | 0.5 | 1005 | 245 | 50 | ○ | 30 | comparison example |
| 19 | B | used | 1250 | 1250 | 8.9 | 995 | 255 | 50 | ○ | 30 | present invention example |
| 20 | C | not used | 1250 | 1250 | 0.5 | 1005 | 245 | 50 | ○ | 30 | comparison example |
| 21 | C | used | 1250 | 1250 | 10.5 | 955 | 295 | 50 | ○ | 30 | present invention example |
| 22 | D | not used | 1250 | 1250 | 0.5 | 1000 | 250 | 50 | ○ | 30 | comparison example |
| 23 | D | used | 1250 | 1250 | 5.5 | 985 | 265 | 50 | ○ | 30 | present invention example |
| 24 | E | not used | 1250 | 1250 | 0.5 | 995 | 255 | 50 | ○ | 30 | comparison example |
| 25 | E | used | 1250 | 1250 | 7.0 | 1025 | 225 | 50 | ○ | 30 | present invention example |
| 26 | F | not used | 1250 | 1250 | 0.5 | 985 | 265 | 50 | ○ | 30 | comparison example |
| 27 | F | used | 1250 | 1250 | 7.5 | 995 | 255 | 50 | ○ | 30 | present invention example |
| 28 | G | not used | 1250 | 1250 | 0.5 | 1005 | 245 | 50 | ○ | 30 | comparison example |
| 29 | G | used | 1250 | 1250 | 8.0 | 1010 | 240 | 50 | ○ | 30 | present invention example |
| 30 | H | not used | 1250 | 1250 | 0.5 | 990 | 260 | 50 | ○ | 30 | comparison example |
| 31 | H | used | 1250 | 1250 | 8.9 | 995 | 255 | 50 | ○ | 30 | present invention example |
| 32 | I | not used | 1250 | 1250 | 0.5 | 1100 | 150 | 50 | ○ | 30 | comparison example |
| 33 | I | used | 1250 | 1250 | 9.5 | 1020 | 230 | 50 | ○ | 30 | present invention example |

* ○: Cooling rate after hot working being 20° C./s or less,

* X: Cooling rate after hot working exceeding 20° C./s

TABLE 3

| Steel plate No. | Steel No. | Microstructure: Kind * | Phase boundary number ratio | Tensile property Yield strength (MPa) | Toughness $vE_{-40}$ (J) | Remarks |
|---|---|---|---|---|---|---|
| 1 | A | M + F + Residual γ | 0.85 | 815 | 33 | comparison example |
| 2 | A | M + F + Residual γ | 0.45 | 820 | 14 | comparison example |
| 3 | A | M + F + Residual γ | 0.92 | 810 | 20 | comparison example |
| 4 | A | M + F + Residual γ | 0.98 | 825 | 35 | comparison example |
| 5 | A | M + F + Residual γ | 1.00 | 820 | 46 | comparison example |
| 6 | A | M + F + Residual γ | 0.87 | 815 | 45 | comparison example |
| 7 | A | M + F + Residual γ | 0.88 | 810 | 41 | comparison example |
| 8 | A | M + F + Residual γ | 0.85 | 805 | 41 | comparison example |
| 9 | A | M + F + Residual γ | 1.85 | 820 | 70 | present invention example |
| 10 | A | M + F + Residual γ | 5.56 | 835 | 108 | present invention example |
| 11 | A | M + F + Residual γ | 7.88 | 875 | 112 | present invention example |
| 12 | A | M + F + Residual γ | 6.98 | 835 | 95 | present invention example |
| 13 | A | M + F + Residual γ | 2.05 | 825 | 72 | present invention example |
| 14 | A | M + F + Residual γ | 1.77 | 830 | 69 | present invention example |
| 15 | A | M + F + Residual γ | 2.35 | 840 | 69 | present invention example |
| 16 | A | M + F + Residual γ | 2.45 | 845 | 75 | present invention example |
| 17 | A | M + F + Residual γ | 0.43 | 645 | 7 | comparison example |
| 18 | B | M + F + Residual γ | 0.98 | 825 | 41 | comparison example |
| 19 | B | M + F + Residual γ | 6.95 | 880 | 115 | present invention example |
| 20 | C | M + F + Residual γ | 0.86 | 865 | 36 | comparison example |
| 21 | C | M + F + Residual γ | 7.33 | 900 | 112 | present invention example |
| 22 | D | M + F + Residual γ | 0.92 | 870 | 37 | comparison example |
| 23 | D | M + F + Residual γ | 5.95 | 935 | 115 | present invention example |
| 24 | E | M + F + Residual γ | 0.91 | 830 | 41 | comparison example |
| 25 | E | M + F + Residual γ | 5.56 | 855 | 99 | present invention example |
| 26 | F | M + F + Residual γ | 0.89 | 750 | 43 | comparison example |
| 27 | F | M + F + Residual γ | 1.85 | 765 | 52 | present invention example |
| 28 | G | M + F + Residual γ | 0.68 | 615 | 38 | comparison example |
| 29 | G | M + F + Residual γ | 1.00 | 620 | 48 | present invention example |
| 30 | H | M + F + Residual γ | 0.88 | 865 | 32 | comparison example |

TABLE 3-continued

| Steel plate No. | Steel No. | Microstructure Kind * | Phase boundary number ratio | Tensile property Yield strength (MPa) | Toughness $vE_{-40}$ (J) | Remarks |
|---|---|---|---|---|---|---|
| 31 | H | M + F + Residual γ | 6.55 | 875 | 95 | present invention example |
| 32 | I | M + F + Residual γ | 0.75 | 785 | 25 | comparison example |
| 33 | I | M + F + Residual γ | 7.50 | 795 | 64 | present invention example |

* M: martensite, F: ferrite, Residual γ: Residual austenite

In all of heavy-walled steel plates manufactured under desired manufacturing conditions by making use of the equipment line of the present disclosure (referred to as the present invention examples here), the microstructure is made finer even at the wall thickness center position of the heavy-walled steel plate, and toughness of the steel plate is remarkably improved such that absorbed energy at a test temperature of −40° C. is 50 J or more in spite of the fact that the steel plate has a yield strength of 654 MPa or more. The present invention example (steel pipe No. 12) having a relatively low working amount (cumulative rolling reduction ratio) of 5% also exhibits remarkably improved toughness. On the other hand, the heavy-walled steel plates which do not fall within a range of desirable manufacturing conditions because of not using the equipment line of the present disclosure or the heavy-walled steel plates which do not fall within the desirable manufacturing conditions although the equipment line of the present disclosure is used (referred to as comparison examples here) do not have desired high strength or high toughness since the microstructure is not made finer.

REFERENCE SIGNS LIST

1 heating device
2 hot working device
3 cooling system
4 thermal insulator
21 piercing device
22 rolling device
221 elongator
222 plug mill
223 sizer (sizing mill) (sizer)

What is claimed is:

1. A method of manufacturing heavy-walled high-strength steel products using an equipment line comprising:

a heating device, a hot working device, a cooling system, which is arranged between the heating device and the hot working device, and a thermal insulator, which is arranged on an exit side of the hot working device, the method comprising:

heating a steel in the heating device at a heating temperature within a range from an $Ac_4$ transformation point to less than a melting point of the steel, cooling the heated steel in the cooling system such that the heated steel is subjected to cooling at an average cooling rate of 1.0° C./s or above on a surface of the steel until a cooling stop temperature is achieved, the cooling stop temperature being at least 600° C. such that a difference between the cooling stop temperature and a cooling start temperature is 50° C. or more, and hot working the cooled steel in the hot working device, and further passing the hot worked steel through the thermal insulator such that a cooling rate of the heavy-walled steel product after the hot working is slowed down to an average cooling rate of 20° C./s or less, so that the hot worked steel has a predetermined size, wherein the steel has a chemical composition comprising:

0.050% or less C, by mass %,
0.50% or less Si, by mass %,
0.20 to 1.80% Mn, by mass %,
15.5 to 18.0% Cr, by mass %,
1.5 to 5.0% Ni, by mass %,
3.5% or less Mo, by mass %,
0.02 to 0.20% V, by mass %,
0.01 to 0.15% N, by mass %,
0.006% or less O, by mass %, and
Fe and unavoidable impurities.

2. The method of manufacturing heavy-walled high-strength stainless steel products according to claim 1, wherein the chemical composition further comprises at least one group selected from the following element groups A to D:

Group A: 0.002 to 0.050% Al, by mass %,

Group B: 3.5% or less Cu, by mass %,

Group C: at least one element selected from 0.2% or less Nb, 0.3% or less Ti, 0.2% or less Zr, 3.0% or less W, and 0.01% or less B, by mass %, and Group D: at least one element selected from 0.01% or less Ca, and 0.01% or less REM, by mass %.

* * * * *